United States Patent [19]

Gentry

[11] 4,170,240

[45] Oct. 9, 1979

[54] PARTS CLEANING MACHINE

[76] Inventor: Richard W. Gentry, 8192 Tokay, Fontana, Calif., 92335

[21] Appl. No.: 847,589

[22] Filed: Nov. 1, 1977

[51] Int. Cl.[2] ..... B08B 3/02

[52] U.S. Cl. ..... 134/57 R; 134/104; 134/107; 134/144; 134/165; 134/181; 134/199

[58] Field of Search ..... 134/57 R, 57 D, 57 DL, 134/104, 165, 144, 147-148, 151, 155, 180-181, 107-108, 199

[56] References Cited

U.S. PATENT DOCUMENTS

| | | | |
|---|---|---|---|
| 1,559,727 | 11/1925 | Merseles et al. | 134/165 X |
| 2,682,881 | 7/1954 | Bocchino | 134/144 X |
| 3,439,689 | 4/1969 | Zadron et al. | 134/165 X |
| 3,796,186 | 3/1974 | Bounds et al. | 134/57 R X |
| 3,844,299 | 10/1974 | Athey et al. | 134/57 D |
| 3,949,772 | 4/1976 | Hartmann | 134/104 X |

FOREIGN PATENT DOCUMENTS

| | | | |
|---|---|---|---|
| 275998 | 11/1969 | Austria | 134/199 |
| 417462 | 8/1925 | Fed. Rep. of Germany | 134/104 |

*Primary Examiner*—Robert L. Bleutge
*Attorney, Agent, or Firm*—Boniard I. Brown

[57] ABSTRACT

A machine for cleaning heavy vehicle parts and the like in maintenance shops by spraying them with a detergent fluid or solvent. A parts tray with wheels may be rolled on tracks in and out of a heavy cabinet. The cabinet has a power-actuated door. Inside a cleaning chamber the parts tray is surrounded by a cage-like spray assembly of pipe equipped with spray nozzles directed inward at the parts. The spray assembly is mounted on a swinging parallel linkage, and is reciprocated back and forth by a motor. Below the spray or cleaning chamber is a tank or sump with an internal heater, which is normally full of fluid. A pump circulates heated fluid from this tank up to the spray nozzles; the fluid then runs back down into the sump for recirculation. A clean-out trap is provided for cleaning the sump. The operator's controls, including the door actuator control, are all located at the side of the machine for safety. An interlock switch prevents the pump from being started when the door is open.

2 Claims, 4 Drawing Figures

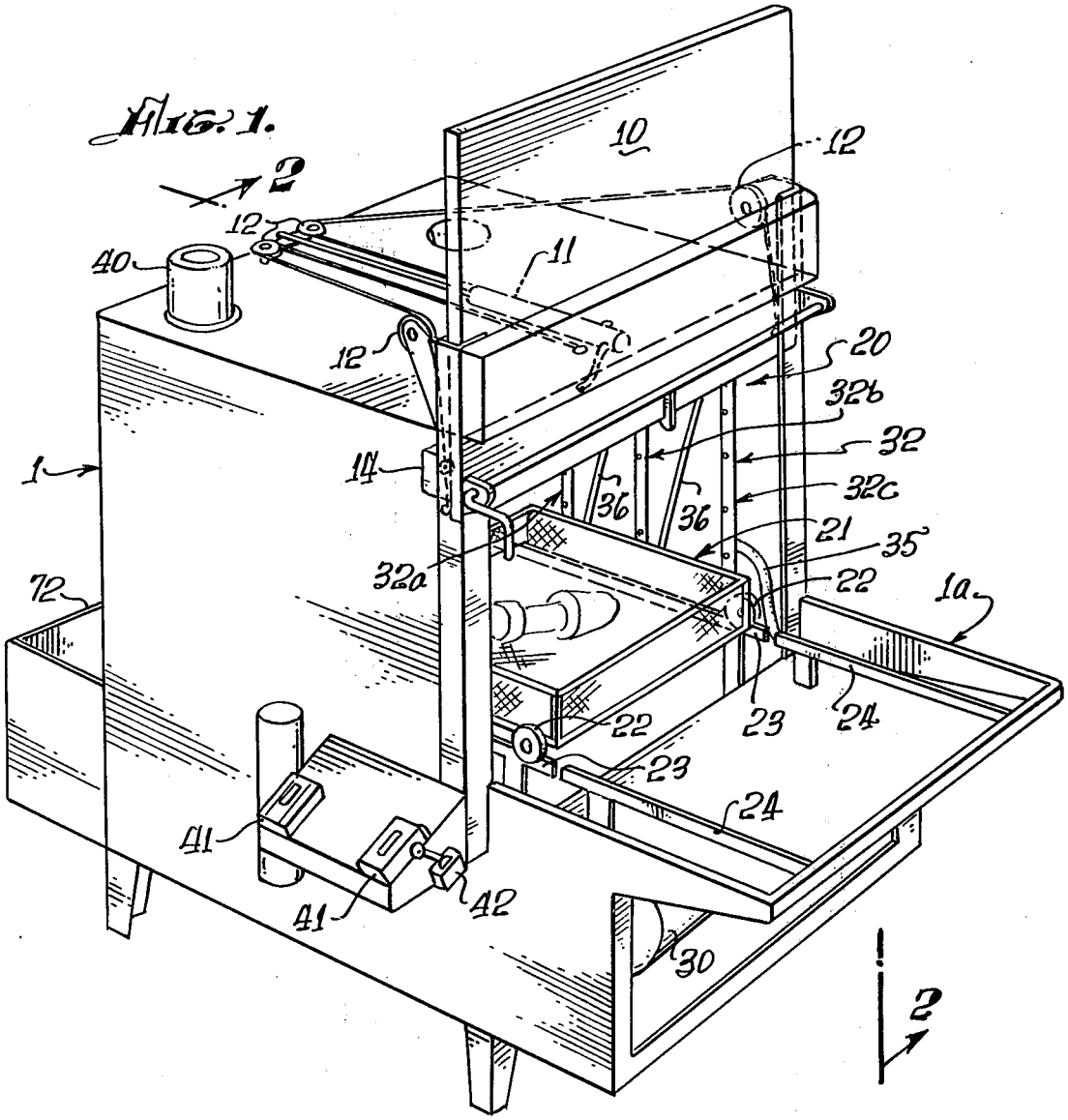
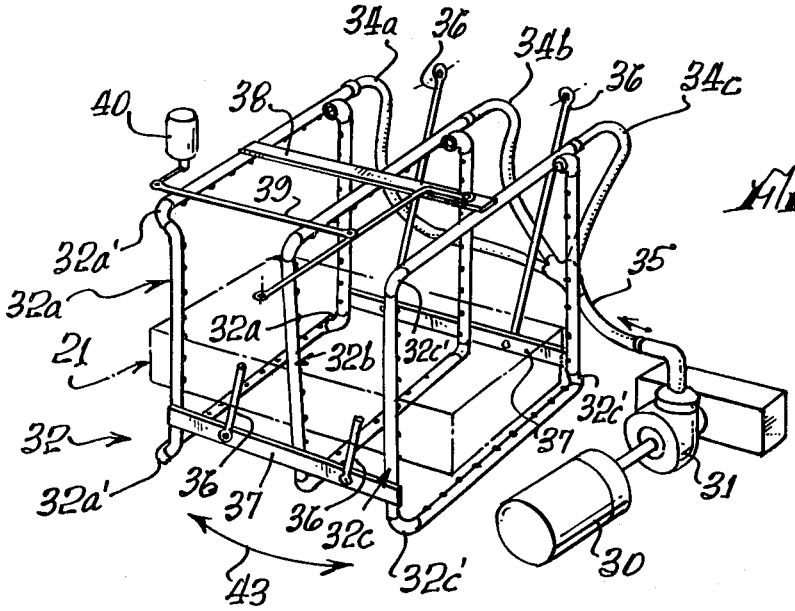
FIG. 3.

PARTS CLEANING MACHINE

BACKGROUND OF THE INVENTION

Parts cleaning machines are used in the maintenance of vehicles such as fleets of trucks, and of construction machinery. Inside the cabinet of a cleaning machine the parts are subjected to a high-pressure spray of a suitable cleaning fluid, commonly a strong detergent in hot water.

Typical prior machine use a plurality of spray nozzles on a rotating carrier, so that the fluid hits the parts from different directions. External heaters are often used to heat the fluid.

There is a need for such a machine that is self-contained and transportable, and adapted to operation in low ambient temperatures (as outdoors in the arctic); it is also desirable to distribute the spray more evenly over the parts being cleaned, and to make it easier to clean the machine itself.

SUMMARY OF THE INVENTION

A parts cleaning machine is built in a large cabinet which is divided by a solid pan into an upper spray chamber and a lower sump or tank.

Parts to be cleaned are placed in a mesh or perforated tray equipped with wheels. Tracks run inside the chamber and out onto a protruding extension of the cabinet, where the tray is loaded and unloaded.

Inside the chamber the parts tray is surrounded by a cage-like spray assembly made of pipe. Nozzles spaced along the pipes are directed inward at the tray. The spray assembly is suspended on a parallel linkage of pivoted rods. A motor and crank swing the assembly back and forth in a generally linear reciprocating motion.

A suitable cleaning fluid such as a hot detergent solution is circulated from the tank or sump to the spray nozzles, by means of a pump. The used fluid runs from the spray chamber back down into the tank and is then recirculated. The tank is kept approximately full by a float valve control located in a box mounted on the back of the cabinet.

A large heating flue tube is coiled inside the upper portion of the tank, to heat the fluid. A gas burner is positioned outside at the entrance to the flue tube. The exit end of the tube extends outside of the tank for connection to a flue.

Screens and filters are provided adjacent the float control and at the pump inlet.

The door to the spray chamber slides up and down. It is preferably power-actuated by a pneumatic cylinder or other suitable actuator via a system of pulleys and cables. A safety door interlock switch prevents the starting of the pump unless the door is closed. The operator's controls are located at the side of the machine, protecting the operator from steam and oil vapors which issue when the door is opened.

The lower portion of the sump is clear of the heater tube and its floor is sloped toward the rear, where a cleanout trap is provided.

DETAILED DESCRIPTION OF THE DRAWINGS

FIG. 1 is a perspective view of a complete machine according to the invention;

FIG. 3 is a perspective view of a spray cage assembly; and

DESCRIPTION OF THE PREFERRED EMBODIMENT

Figures 2, 4:
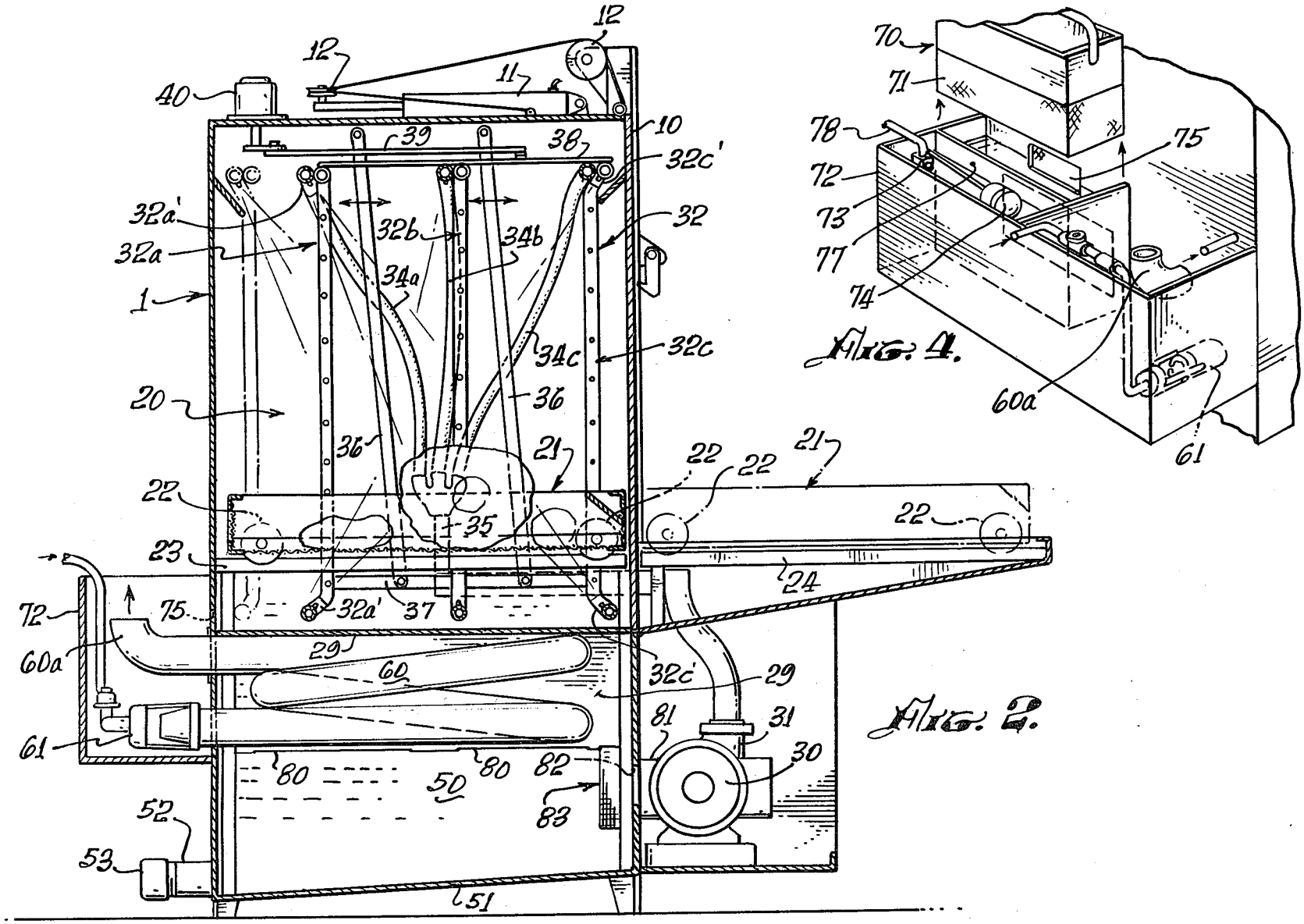
FIG. 2 is a side sectional view on line 2—2 of FIG. 1.
FIG. 4 is a partial perspective view of the back of a machine.

Referring first to FIG. 1, the machine is built in a large cabinet indicated generally at 1, enclosing an interior chamber 20. Parts (not shown) to be cleaned are placed in a basket or tray 21 with a wire mesh or perforated bottom. Tray 21 is equipped with wheels 22 which roll on tracks 23, 24 for moving it in and out of the chamber 20. Outer tracks 24 are mounted on a front extension portion 1*a* of the cabinet 1. Tray 21 is rolled out onto these for loading and unloading. A gap is provided between the inside tracks 23 and the outside tracks 24 to provide clearance for a door 10, which slides up and down.

A mechanism for raising and lowering the door 10 is shown in FIGS. 1 and 2 as a long-stroke pneumatic cylinder 11 connected to a suitable arrangement of flexible cables and pulleys indicated generally at 12. When the piston rod moves out of cylinder 11, it moves the pulley assembly back, applying tension to the cables and pulling the door 10 upward to open it.

An interlock safety switch, indicated at 14, is provided. This switch is so disposed that it is closed only when the door 10 is closed, and connected so as to prevent operation of the spray pump (to be described presently) unless the door is closed.

Manual controls for the door, pump, and spray reciprocator (described below) are located at 41, 42 on the side of the machine, for the safety of the operator.

In operation, parts to be cleaned are placed in tray 21 when it is on the outside tracks 24 over the cabinet extension 1a. The tray of parts is then wheeled inside the chamber 20 and the door 10 closed. The spray equipment is then turned on, spraying the parts with hot detergent solution or other suitable fluid under pressure, to loosen and flush away coatings of grease, encrustations of dirt and the like.

The spraying system will now be described. Referring first to FIG. 3, a cage-like assembly of pipes indicated generally at 32 surrounds the parts tray 21 (shown in broken lines) inside the chamber. The spray pipes 32*a*, 32*b*, 32*c* are each provided with many spray nozzles 33 along their length, all the nozzles facing inward. The parts are thus sprayed with fluid from the top, sides, and bottom.

The end spray pipes 32*a*, 32*c* are offset toward the outside at top and bottom as shown at 32*a*', 32*c*', FIG. 3, so that their horizontal portions lie in planes beyond the planes of the vertical portions. This prevents the fluid streams from the horizontal and vertical pipe portions from colliding in mid-air, and so preserves their kinetic energy for impact with the parts being cleaned.

To further distribute the spray the entire cage assembly 32 is moved cyclically back and forth in a generally reciprocating path, indicated by arrow 43, FIG. 3. To accommodate this motion the pipes 32*a*–32*c* are fed with fluid through flexible hoses 34*a*–34*c* which join a single supply hose or pipe 35. This is connected in turn to the outlet of a fluid pump 31.

The reciprocating linkage for the cage 32 is shown in FIGS. 2 and 3. The three spray pipes 32*a*, 32*b*, 32*c*, each bent in about the shape of a square, are held in spaced parallel relation by straps 37, 38. These may be heavy metal straps welded to the pipes. Preferably an upper strap 38 is welded across the tops of the pipes (FIG. 3) and two lower straps 37, 37 are welded along the bottom portions of the spray pipes. Swing rods 36 are preferably pivoted to the lower straps 37, and also pivoted at their upper ends to suitable portions of the interior of the cabinet as at 41 in FIG. 2. Four such rods 36 are provided as indicated in FIG. 3. It will be seen that they provide a parallel suspension linkage in the manner of a platform swing, permitting the cage to swing back and forth as indicated by arrow 43, FIG. 3, with orientation unchanged but rising slightly toward either end of the stroke. This rise and fall is in practice less than about 1 cm, and is neglected as not affecting the operation of the machine.

The motive power for this swinging reciprocation of the spray cage assembly is provided by a suitable gearhead motor 40 operating at, for example, about 100 rpm. This motor 40 may be mounted on top of the cabinet, FIGS. 1 and 2, with its output shaft extending inside the chamber 20. A crank arm on its output shaft is pivoted to a suitable connecting rod 39, FIGS. 2 and 3. The rod 39 is linked to the upper strap 38 in a manner suitable for moving the spray cage assembly 32 in swinging reciprocation as described.

In a working machine the chamber 20 may be approximately cubical, and measure about 1 meter on a side.

The sprayed cleaning fluid, preferably a hot detergent solution, is recirculated. Referring to FIG. 2 the bottom of the compartment or chamber 20 in which the parts are sprayed is bounded at its bottom by a solid floor or pan 29. The sprayed fluid from the cage 32 runs down through an opening 80 into a sump tank at compartment 50, whose bottom is closed by a bottom portion 51 of cabinet 1. At the lower right-hand portion of FIG. 2, the inlet 81 of the fluid circulating pump 30 draws fluid from the sump compartment 50 through an opening 82 in the wall via a filter 83. The pump then discharges the fluid under pressure into the spray cage as described above.

Sump compartment 50 is normally substantially full of fluid. Its bottom wall 51 is sloped downward toward the rear of the machine, FIG. 2. At the back is provided a drain opening 52 for cleaning out the sludge which accumulates at the bottom. Drain 52 is provided with a suitable pipe cap 53.

An improved heating means is provided to heat the fluid in the sump compartment 50. This is a coil of about one-and-a-half turns of large-diameter metal tubing 60 which enters and leaves the compartment 50 through sealed joints in the back wall, FIG. 2. The tubing 60 is a flue or duct for the hot products of combustion of a gas burner 61 which is fed from a fuel gas line 62, FIGS. 2 and 4. The hot combustion products circulate through the tubing 60 and out through the exhaust end **60*a*, FIG. 2. The exhaust end 60*a*** communicates into a suitable chimney, not shown.

This heating flue is positioned well above the bottom 51 of sump compartment 50 to leave room for the accumulation of sludge. It is of relatively large-diameter tubing to provide a surface of simple shape to facilitate cleaning. With this structure, the compartment can readily be cleaned by running a hose into the drain pipe 52, FIG. 2.

The fluid level in the sump compartment 50 is maintained at the preferred level of nearly-full by a float valve system shown in FIG. 4. This partial back perspective view shows an inlet tank or box 72 which communicates with the compartment 50 through an opening 75. Inlet box 72 is divided into two communicating compartments by a partition 77 with a suitable opening in it. A float 74 connected to a float valve 73 controls a supply of water (or other suitable fluid) coming in from an outside supply through a pipe 78. This mechanism may be similar to those used in toilet tanks.

Between the opening 75 at the back of the sump tank 50 and the partition 77 is the compartment 76. A removable sludge collector 70 fits into this compartment. In FIG. 4 it is shown raised up out of the compartment 76 for clarity of illustration. The sludge collector 70 is in the shape of a box open at the top with its lower portion made of wire mesh or similar open material such as perforated or expanded sheet metal. Sludge entering compartment 76 from opening 75 drops into the collector 70. Collector 70 is equipped with a handle on top by which it may be pulled out for cleaning.

The machine of the invention is self-contained including the fluid heater 60–62, and so is readily transportable and quickly set up for use, as is often required in construction projects in remote locations. For use outdoors in cold weather the cabinet 1 may be provided with thermal insulation over its exterior (not shown).

The cage-like disposition of the spray nozzles at 32, 33, with its reciprocating motion, is found to clean parts faster and more thoroughly than prior machines which rotate the spray means or rotate the parts tray, because a greater portion of the total surface area of the parts falls in the direct path of spray from one or more nozzles. Vehicle and machine parts are more difficult to clean than, for example, dishes, because of their variety of complicated shapes and the nature of the dirt.

The power-actuated door 10, the interlock 14, and the location of the controls 40–42 on the side of the machine (FIG. 1) improves the safety of operation. The operator must stand to the side to operate the door and the pump, safely away from hot steam and oil vapors which come out when the door is opened, and clear of possible injury when the door comes down.

The inventor claims:

1. In a parts cleaning machine:

a cabinet having a door in its front wall portion, a horizontal pan dividing said cabinet into a spray chamber and a sump compartment below the chamber, wheel tracks within said chamber and extending outwardly beyond said door for loading, a parts tray having supporting wheels adapted to engage said tracks, a spray cage comprising a plurality of generally rectangular spaced loops of pipe with nozzles facing inwardly, said loops being rigidly connected by an upper strap member along the top and lower strap members disposed at each side, swing rods pivoted to said lower strap members and to the upper side portions of said cabinet to form a swingable parallel linkage, a low-speed motor having an output crank and mounted on the upper portion of said cabinet, and connecting rods connecting said crank to said upper strap member to cause said cage to swing in reciprocation, a pump having an inlet from said sump and an outlet via flexible hoses to said loops of pipes, a drain opening from said chamber into said sump compartment, an inlet box attached to the rear of said cabinet and comprising an inlet tank with a float valve and a connection to a fluid supply, and having an opening into said sump compartment, a heating flue in the upper portion of said sump compartment with a substantial space below said flue for the accumulation of sludge, and a cleanout trap at the bottom rear portion of said sump compartment, the bottom of said compartment sloping downward toward said trap.

2. A parts cleaning machine according to claim 1 wherein:

said loops of pipe are three in number, and the upper and lower horizontal leg portions of the two outer loops are in planes displaced outwardly from the plane of the vertical leg portions, whereby spray streams from nozzles in said vertical and horizontal leg portions do not intersect.

* * * * *